US011724910B2

(12) United States Patent
Witczak et al.

(10) Patent No.: US 11,724,910 B2
(45) Date of Patent: Aug. 15, 2023

(54) MONITORING OF CONVEYANCE SYSTEM VIBRATORY SIGNATURES

(71) Applicant: OTIS ELEVATOR COMPANY, Farmington, CT (US)

(72) Inventors: Tadeusz Pawel Witczak, Farmington, CT (US); Craig Drew Bogli, Avon, CT (US); Ezhil Nanjappan, Farmington, CT (US); Yrinee Michaelidis, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1271 days.

(21) Appl. No.: 16/036,181

(22) Filed: Jul. 16, 2018

(65) Prior Publication Data

US 2019/0382238 A1 Dec. 19, 2019

Related U.S. Application Data

(60) Provisional application No. 62/685,404, filed on Jun. 15, 2018.

(51) Int. Cl.
*B66B 5/00* (2006.01)

(52) U.S. Cl.
CPC ..... *B66B 5/0018* (2013.01)

(58) Field of Classification Search
CPC ..... B66B 1/3492; B66B 5/0006; B66B 5/0018–0031; B66B 5/02–22
See application file for complete search history.

(56) References Cited

U.S. PATENT DOCUMENTS

| | | | | |
|---|---|---|---|---|
| 5,760,350 | A | 6/1998 | Pepin et al. | |
| 6,474,449 | B1 * | 11/2002 | Utsunomiya | B66B 7/042 187/292 |
| 6,543,583 | B1 | 4/2003 | Lence Barreiro et al. | |
| 8,678,143 | B2 * | 3/2014 | Bunter | B66B 13/143 187/247 |
| 10,766,741 | B2 * | 9/2020 | De Angelis | B66B 3/002 |
| 2003/0000777 | A1 | 1/2003 | Lence Barreiro et al. | |

(Continued)

FOREIGN PATENT DOCUMENTS

| | | |
|---|---|---|
| EP | 2489621 A1 | 8/2012 |
| WO | 0114237 | 3/2001 |
| WO | 2016193077 A1 | 12/2016 |

OTHER PUBLICATIONS

The Extended European Search Report for Application No. 19180704.9-1017; dated Jan. 30, 2020; dated Feb. 24, 2020; 12 pages.

(Continued)

*Primary Examiner* — Christopher Uhlir
(74) *Attorney, Agent, or Firm* — Cantor Colburn LLP

(57) ABSTRACT

A method of monitoring a conveyance system is provided. The method including: monitoring vibratory signatures along a first axis of a conveyance apparatus of a conveyance system; detecting a vibratory signature along the first axis about equivalent to a vibratory signature of significant event; and examining vibratory signatures for a secondary event along at least one of the first axis and a second axis of the conveyance apparatus for at least one of a selected time period after detection of the significant event and a selected time period before detection of the significant event.

18 Claims, 6 Drawing Sheets

(56) References Cited

U.S. PATENT DOCUMENTS

| | | | |
|---|---|---|---|
| 2003/0217894 | A1 | 11/2003 | Perala et al. |
| 2004/0007429 | A1 | 1/2004 | Angst et al. |
| 2004/0094366 | A1 | 5/2004 | Weinberger et al. |
| 2005/0029055 | A1 | 2/2005 | Deplazes et al. |
| 2007/0016332 | A1 | 1/2007 | Tyni et al. |
| 2007/0215413 | A1 | 9/2007 | Tyni et al. |
| 2008/0060883 | A1 | 3/2008 | Tyni et al. |
| 2008/0173502 | A1 | 7/2008 | Tyni et al. |
| 2008/0179143 | A1 | 7/2008 | Tyni |
| 2009/0218177 | A1 | 9/2009 | Tyni et al. |
| 2011/0168496 | A1 | 7/2011 | Bunter |
| 2012/0193169 | A1 | 8/2012 | Mizon |
| 2012/0325588 | A1 | 12/2012 | Loeb et al. |
| 2013/0081906 | A1 | 4/2013 | Studer |
| 2014/0008152 | A1 | 1/2014 | Annen et al. |
| 2014/0058700 | A1 | 2/2014 | Gehrke |
| 2014/0182978 | A1 | 7/2014 | Bunter |
| 2014/0339024 | A1 | 11/2014 | Tyni et al. |
| 2015/0068850 | A1 | 3/2015 | Mattsson et al. |
| 2016/0009528 | A1 | 1/2016 | Koketsu |

OTHER PUBLICATIONS

English Translation of Dekra: "Likos (Lift Kontroll System) Lift 1-15 Explorer Ergebnisbericht", Feb. 3, 2014; 19 pages.
Dekra: "Likos (Lift Kontroll System) Lift 1-15 Explorer Ergebnisbericht", Feb. 3, 2014; 25 pages.

* cited by examiner

MONITORING OF CONVEYANCE SYSTEM VIBRATORY SIGNATURES

CROSS-REFERENCE TO RELATED APPLICATIONS

This application claims priority to and the benefit of U.S. Provisional Patent Application Ser. No. 62/685,404, filed on Jun. 15, 2018, and all the benefits accruing therefrom under 35 U.S.C. § 119, the content of which is incorporated herein in its entirety by reference.

BACKGROUND

The embodiments herein relate to the field of conveyance systems, and specifically to a method and apparatus for monitoring a conveyance system.

Conveyance systems, such as, for example, elevator systems, escalator systems, and moving walkways may require periodic monitoring to perform diagnostics, which typically requires a technician to be called and perform a manual inspection of the system in the field.

BRIEF SUMMARY

According to an embodiment, a method of monitoring a conveyance system is provided. The method including: monitoring vibratory signatures along a first axis of a conveyance apparatus of a conveyance system; detecting a vibratory signature along the first axis about equivalent to a vibratory signature of significant event; and examining vibratory signatures for a secondary event along at least one of the first axis and a second axis of the conveyance apparatus for at least one of a selected time period after detection of the significant event and a selected time period before detection of the significant event.

In addition to one or more of the features described herein, or as an alternative, further embodiments may include: detecting a vibratory signature along at least one of the first axis and the second axis about equivalent to a vibratory signature of a secondary event of the conveyance apparatus; and determining that the secondary event of the conveyance apparatus has occurred in response to the vibratory signature.

In addition to one or more of the features described herein, or as an alternative, further embodiments may include: detecting no vibratory signatures along at least one of the first axis and the second axis about equivalent to a vibratory signature of a secondary event of the conveyance apparatus; and determining that the secondary event of the conveyance apparatus has not occurred in response to the vibratory signature.

In addition to one or more of the features described herein, or as an alternative, further embodiments may include that the conveyance system is an elevator system and the conveyance apparatus is an elevator car.

In addition to one or more of the features described herein, or as an alternative, further embodiments may include that the significant event is a motion profile change of the elevator car.

In addition to one or more of the features described herein, or as an alternative, further embodiments may include that vibratory signatures along a first axis are detected at a header of the elevator car.

In addition to one or more of the features described herein, or as an alternative, further embodiments may include that the conveyance system is an elevator system and the conveyance apparatus is an elevator car, the significant event is the elevator car stopping, the secondary event is a door of the elevator car opening or closing.

In addition to one or more of the features described herein, or as an alternative, further embodiments may include that the first axis is oriented about parallel to a hoistway of the elevator system in a direction of gravity.

In addition to one or more of the features described herein, or as an alternative, further embodiments may include that the second axis is about perpendicular to the first axis.

In addition to one or more of the features described herein, or as an alternative, further embodiments may include that the second axis is about parallel to doors of the elevator car.

According to another embodiment, a sensing apparatus for monitoring a conveyance system is provided. The sensing apparatus including: an inertial measurement unit configured to measure vibratory signatures of a conveyance apparatus of the conveyance system; a controller configured to analyze the vibratory signatures, the controller including: a processor; and a memory including computer-executable instructions that, when executed by the processor, cause the processor to perform operations, the operations including: monitoring vibratory signatures along a first axis of a conveyance apparatus of a conveyance system; detecting a vibratory signature along the first axis about equivalent to a vibratory signature of significant event; and examining vibratory signatures for a secondary event along at least one of the first axis and a second axis of the conveyance apparatus for at least one of a selected time period after detection of the significant event and a selected time period before detection of the significant event.

In addition to one or more of the features described herein, or as an alternative, further embodiments may include that the operations further include: detecting a vibratory signature along at least one of the first axis and the second axis about equivalent to a vibratory signature of a secondary event of the conveyance apparatus; and determining that the secondary event of the conveyance apparatus has occurred in response to the vibratory signature.

In addition to one or more of the features described herein, or as an alternative, further embodiments may include that the operations further include: detecting no vibratory signatures along at least one of the first axis and the second axis about equivalent to a vibratory signature of a secondary event of the conveyance apparatus; and determining that the secondary event of the conveyance apparatus has not occurred in response to the vibratory signature.

In addition to one or more of the features described herein, or as an alternative, further embodiments may include that the conveyance system is an elevator system and the conveyance apparatus is an elevator car.

In addition to one or more of the features described herein, or as an alternative, further embodiments may include that the significant event is a motion profile change of the elevator car.

In addition to one or more of the features described herein, or as an alternative, further embodiments may include that vibratory signatures along a first axis are detected at a header of the elevator car.

In addition to one or more of the features described herein, or as an alternative, further embodiments may include that the conveyance system is an elevator system and the conveyance apparatus is an elevator car, the significant event is the elevator car stopping, the secondary event is a door of the elevator car opening or closing.

In addition to one or more of the features described herein, or as an alternative, further embodiments may include that the first axis is oriented about parallel to a hoistway of the elevator system in a direction of gravity.

In addition to one or more of the features described herein, or as an alternative, further embodiments may include that the second axis is about perpendicular to the first axis.

In addition to one or more of the features described herein, or as an alternative, further embodiments may include that the second axis is about parallel to doors of the elevator car.

Technical effects of embodiments of the present disclosure include removably attaching a sensing apparatus to monitor vibration on a single axis for a significant event and then analyzing vibration on additional axis once the significant event occur has occurred to determine whether a secondary event has occurred.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
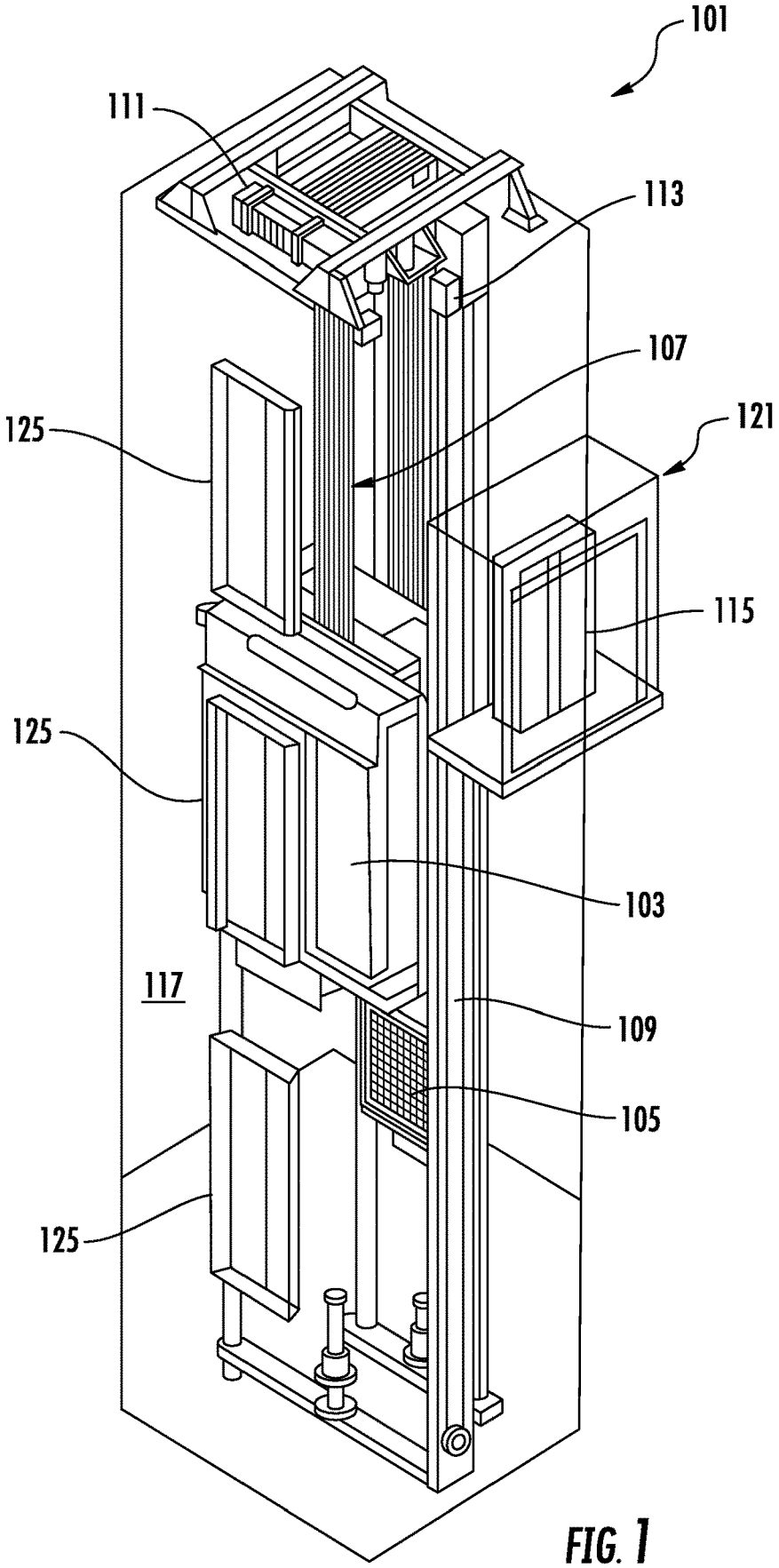
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

In other embodiments, the system comprises a conveyance system that moves passengers between floors and/or along a single floor. Such conveyance systems may include escalators, people movers, etc. Accordingly, embodiments described herein are not limited to elevator systems, such as that shown in FIG. 1. In one example, embodiments disclosed herein may be applicable conveyance systems such as an elevator system 101 and a conveyance apparatus of the conveyance system such as an elevator car 103 of the elevator system 101. In another example, embodiments disclosed herein may be applicable conveyance systems such as an escalator system and a conveyance apparatus of the conveyance system such as a moving stair of the escalator system.

Figures 2, 3:
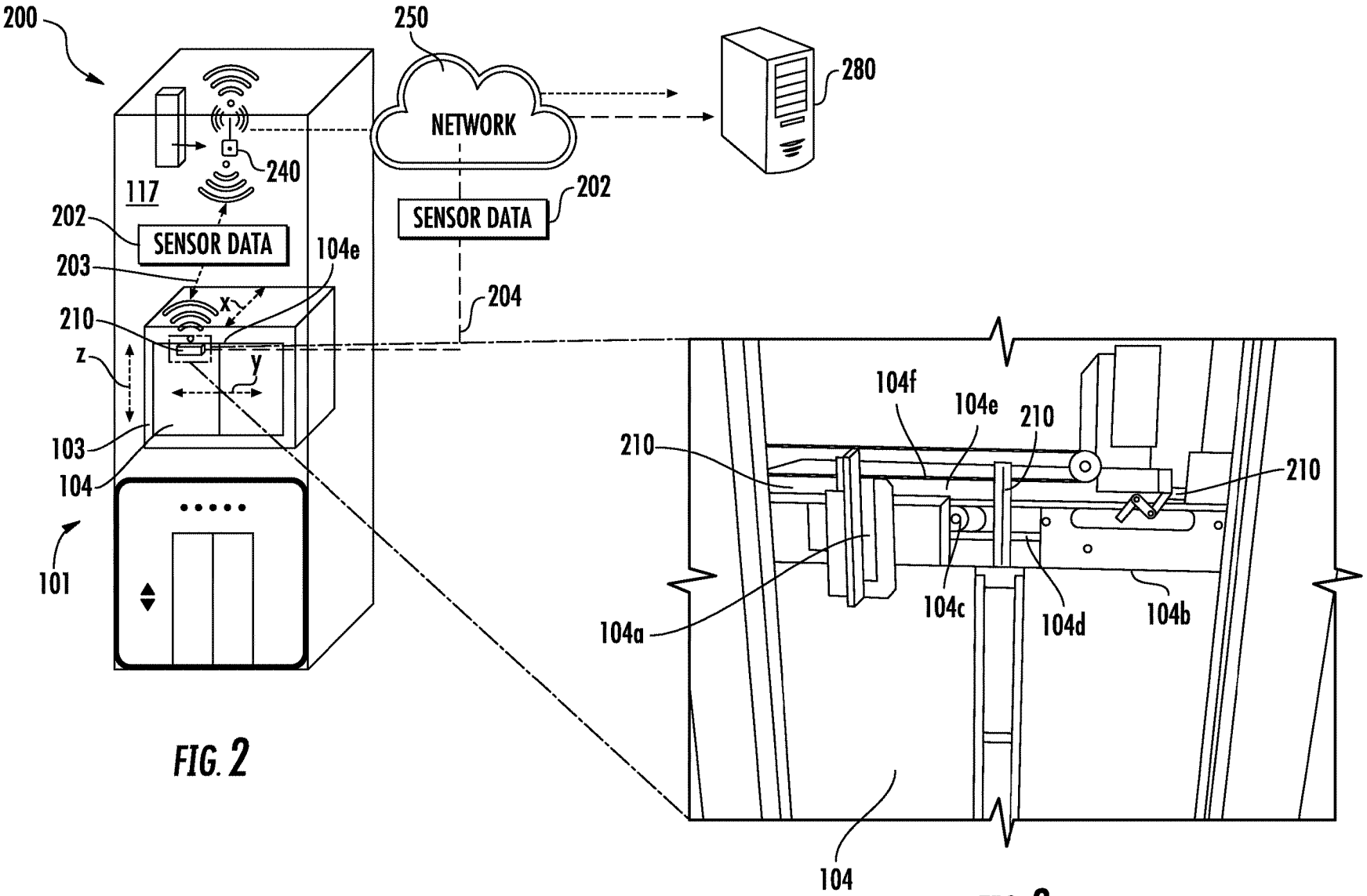
FIG. 2 is a schematic illustration of a sensor system for the elevator system of FIG. 1, in accordance with an embodiment of the disclosure.
FIG. 3 is a schematic illustration of the location of sensing apparatus of the sensor system of FIG. 2, in accordance with an embodiment of the disclosure.

FIG. 2 is a view of a sensor system 200 including a sensing apparatus 210, according to an embodiment of the present disclosure. The sensing apparatus 210 is configured to detect sensor data 202 of the elevator car 103 and transmit the sensor data 202 to a remote device 280. Sensing data 202 may include but is not limited to vibratory signatures 310 (i.e., vibrations over a period of time) or accelerations and derivatives or integrals of accelerations, such as, for example, velocity, jerk, jounce, snap . . . etc. Sensing data 202 may also include light, pressure, sound, humidity, and temperature. In an embodiment, the sensing apparatus 210 is configured to transmit sensor data 202 that is raw and unprocessed to the remote system 280 for processing. In an embodiment, the sensing apparatus 210 is configured to process the sensor data 202 prior to transmitting the sensor data 202 to the remote device 280. The processing of the sensor data 202 may reveal data, such as, for example, a number of elevator door openings/closings, elevator door time, vibrations, vibratory signatures, a number of elevator rides, elevator ride performance, elevator flight time, relative and absolute car position (e.g. elevation, floor number), releveling events, rollbacks, car x, y acceleration at a position: (i.e., rail topology), door performance at a landing number, nudging event, vandalism events, emergency stops, etc. The remote device 280 may be a computing device, such as, for example, a desktop or cloud computer. The remote device 280 may also be a mobile computing device that is typically carried by a person, such as, for example a smartphone, PDA, smartwatch, tablet, laptop, etc. The end user device 280 may also be two separate devices that are synced together, such as, for example, a cellular phone and a desktop computer synced over an internet connection. The remote device 280 may also be a cloud computing network.

The sensing apparatus 210 is configured to transmit the sensor data 202 a remote device 280 via short-range wireless protocols 203 and/or long-range wireless protocols 204. Short-range wireless protocols 203 may include but are not limited to Bluetooth, Wi-Fi, HaLow (801.11ah), zWave, Zigbee, or Wireless M-Bus. Using short-range wireless protocols 203, the sensing apparatus 210 is configured to transmit the sensor data 202 to a local gateway device 240 and the local gateway device 240 is configured to transmit the sensor data 202 to a remote device 280 through a network 250. The network 250 may be a computing network, such as, for example, a cloud computing network, cellular network, or any other computing network known to one of skill in the art. Using long-range wireless protocols 204, the sensing apparatus 210 is configured to transmit the sensor data 202 to a remote device 280 through a network 250. Long-range wireless protocols 204 may include but are not limited to cellular, satellite, LTE (NB-IoT, CAT M1), LoRa, Satellite, Ingenu, or SigFox.

FIG. 2 shows a possible installation location of the sensing apparatus 210 within the elevator system 101. In an embodiment, the sensing apparatus 210 may be attached to a door header 104*e* of a door 104 of the elevator car 103. Advantageously, by attaching the sensing apparatus 210 to the door header 104*e* of the elevator car 103 the sensing apparatus 210 may detect accelerations of the elevator car 103 and while being relatively isolated from vibrations from the doors 104 of the elevator car 103 when the doors 104 are not opening or closing. For example, when located on the door 104, the sensing apparatus 210 may detect when the elevator car 103 is in motion, when the elevator car 103 is slowing, when the elevator car 103 is stopping, and when the doors 104 open to allow passengers to exit and enter the elevator car 103 because when the doors 104 open and close the vibrations will be transferred to the header 104*e*. It is understood that the sensing apparatus 210 may also be installed in other locations other than the header 104*e* of the elevator system 101. In another embodiment, the sensing apparatus 210 is installed on a door 104 structure of the elevator car 103. The sensing apparatus 210 may be configured to detect sensor data 202 including acceleration in any number of directions. In an embodiment, the sensing apparatus may detect sensor data 202 including accelerations along three axis, an X axis, a Y axis, and a Z axis, as show in in FIG. 2. The X axis may be perpendicular to the doors 104 of the elevator car 103, as shown in FIG. 2. The Y axis may be parallel to the doors 104 of the elevator car 103, as shown in FIG. 2. The Z axis may be aligned vertically parallel with the elevator shaft 117 and pull of gravity, as shown in FIG. 2.

FIG. 3 is an enlarged view of multiple possible installation locations of the sensing apparatus 210 along the door header 104*e*. As shown in FIG. 3, the sensing apparatus 201 may be located on a door header 104*e* proximate a top portion 104*f* of the elevator car 103. The doors 104 are operably connected to the door header 104*e* through a door hanger 104*a* located proximate a top portion 104*b* of the door 104. The door hanger 104*a* includes guide wheels 104*c* that allow the door 104 to slide open and close along a guide rail 104*d* on the door header 104*e*.

Advantageously, the door header 104*e* is an easy to access area to attach the sensing apparatus 210 because the door header 104*e* is accessible when the elevator car 103 is at landing 125 and the elevator door 104 is open. Thus, installation of the sensing apparatus 210 is possible without taking special measures to take control over the elevator car 103. For example, the additional safety of an emergency door stop to hold the elevator door 104 open is not necessary as door 104 opening at landing 125 is a normal operation mode. The door header 104*e* also provides ample clearance for the sensing apparatus 210 during operation of the elevator car 103, such as, for example, door 104 opening and closing.

Due to the mounting location of the sensing apparatus 210 on the door header 104*e*, sensing apparatus 210 may be able to detect door 104 an open and close motion (i.e., acceleration) but not as clearly as a sensing apparatus 210 located on the door 104. However, advantageously, mounting the sensing apparatus 210 on the header 104*e* allows for clearer recording of a ride quality of the elevator car 103, which is equally important and would not be possible if the sensing apparatus 210 was mounted on the door 104 due to additional vibration of the door 104 during the elevator car 103 motion.

Figure 4:
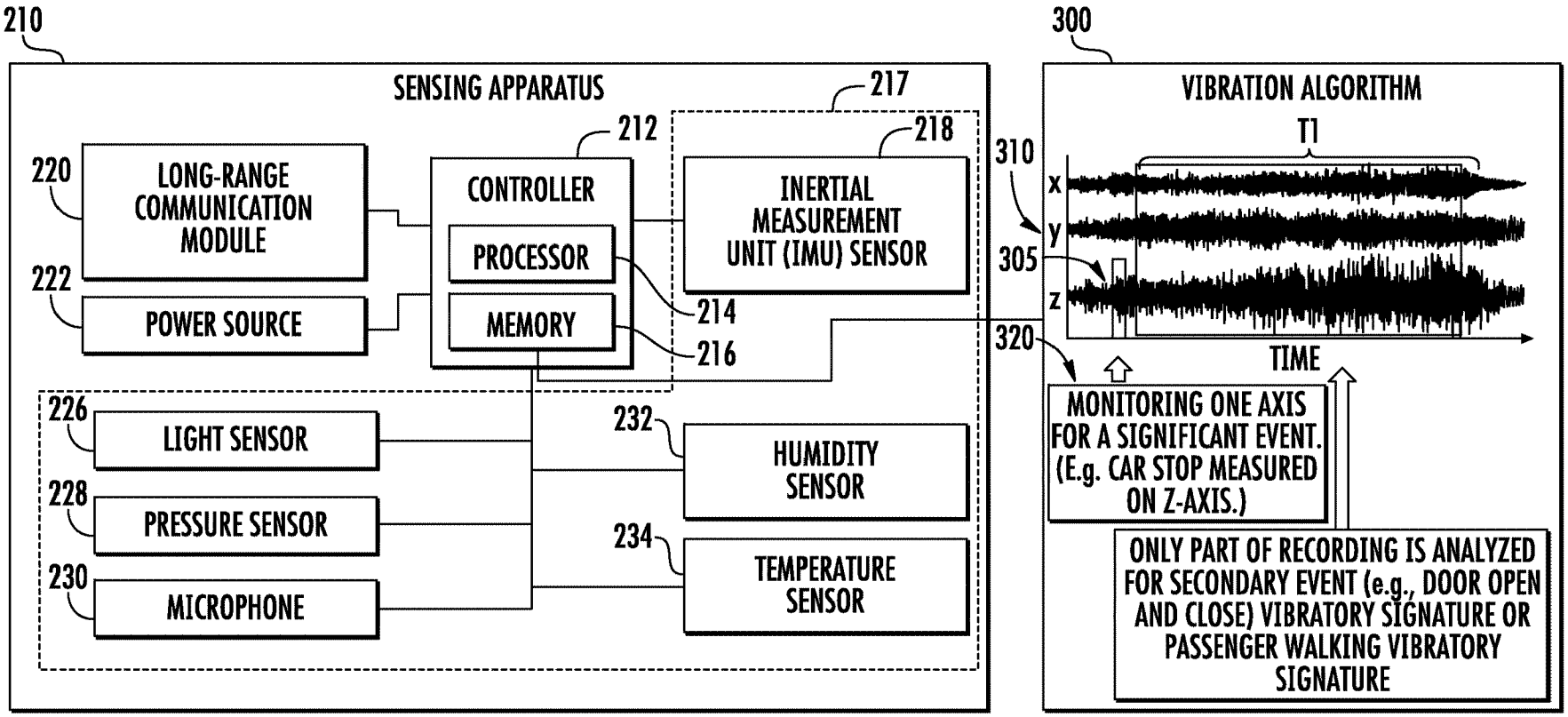
FIG. 4 illustrates a block diagram of a sensing apparatus of the sensing system of FIG. 2, in accordance with an embodiment of the disclosure.

FIG. 4 illustrates a block diagram of the sensing apparatus 210 of the sensing system of FIG. 2. It should be appreciated that, although particular systems are separately defined in the schematic block diagram of FIG. 4, each or any of the systems may be otherwise combined or separated via hardware and/or software. As shown in FIG. 4, the sensing apparatus 210 may include a controller 212, a plurality of sensors 217 in communication with the controller 212, a communication module 220 in communication with the controller 212, and a power source 222 electrically connected to the controller 212.

The plurality of sensors 217 includes an inertial measurement unit (IMU) sensor 218 configured to detect sensor data 202 of the sensing apparatus 210 and the elevator car 103 when the sensing apparatus 210 is attached to the elevator car 103. The IMU sensor 218 may be a sensor, such as, for example, an accelerometer, a gyroscope, or a similar sensor known to one of skill in the art. The sensor data 202 detected by the IMU sensor 218 may include accelerations as well as derivatives or integrals of accelerations, such as, for example, velocity, jerk, jounce, snap . . . etc. The IMU sensor 218 is in communication with the controller 212 of the sensing apparatus 210.

The plurality of sensors 217 may also include additional sensors including but not limited to a light sensor 226, a pressure sensor 228, a microphone 230, a humidity sensor 232, and a temperature sensor 234. The light sensor 226 is configured to detect sensor data 202 including light exposure. The light sensor 226 is in communication with the controller 212. The pressure sensor 228 is configured to detect sensor data 202 including pressure levels. The pressure sensor 228 is in communication with the controller 212. The microphone 230 is configured to detect sensor data 202 including audible sound and sound levels. The microphone 230 is in communication with the controller 212. The humidity sensor 232 is configured to detect sensor data 202 including humidity levels. The humidity sensor 232 is in communication with the controller 212. The temperature sensor 234 is configured to detect sensor data 202 including temperature levels. The temperature sensor 234 is in communication with the controller 212.

The controller 212 of the sensing apparatus 210 includes a processor 214 and an associated memory 216 comprising computer-executable instructions that, when executed by the processor 214, cause the processor 214 to perform various operations, such as, for example, processing the sensor data 202 collected by the IMU sensor 218, the light sensor 226, the pressure sensor 228, the microphone 230, the humidity sensor 232, and the temperature sensor 234. The processor 214 may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 216 may be a storage device, such as, for example, a random access memory (RAM), read only memory (ROM), or other electronic, optical, magnetic or any other computer readable medium.

The power source 222 of the sensing apparatus 210 is configured to store and supply electrical power to the sensing apparatus 210. The power source 222 may include an energy storage system, such as, for example, a battery system, capacitor, or other energy storage system known to one of skill in the art. The power source 222 may also generate electrical power for the sensing apparatus 210. The power source 222 may also include an energy generation or electricity harvesting system, such as, for example synchronous generator, induction generator, or other type of electrical generator known to one of skill in the art.

The sensing apparatus 210 includes a communication module 220 configured to allow the controller 212 of the sensing apparatus 210 to communicate with the remote device 280 through at least one of short-range wireless protocols 203 and long-range wireless protocols 204. The communication module 220 may be configured to communicate with the remote device 280 using short-range wireless protocols 203, such as, for example, Bluetooth, Wi-Fi, HaLow (801.11ah), Wireless M-Bus, zWave, Zigbee, or other short-range wireless protocol known to one of skill in the art. Using short-range wireless protocols 203, the communication module 220 is configured to transmit the sensor data 202 to a local gateway device 240 and the local gateway device 240 is configured to transmit the sensor data to a remote device 280 through a network 250, as described above. The communication module 220 may be configured to communicate with the remote device 280 using long-range wireless protocols 204, such as for example, cellular, LTE (NB-IoT, CAT M1), LoRa, Ingenu, SigFox, Satellite, or other long-range wireless protocol known to one of skill in the art. Using long-range wireless protocols 204, the communication module 220 is configured to transmit the sensor data 202 to a remote device 280 through a network 250. In an embodiment, the short-range wireless protocol 203 is sub GHz Wireless M-Bus. In another embodiment, the long-range wireless protocol is Sigfox. In another embodiment, the long-range wireless protocol is LTE NB-IoT or CAT M1 with 2G fallback.

The sensing apparatus 210 also includes an algorithm 300 configured to analyze vibratory signatures 310 in multiple axis of the elevator car 103. The axis may include three axis such as the X axis, a Y axis, and a Z axis, as shown in FIG. 2. In one embodiment, the algorithm 300 may be configured to analyze vibratory signatures 310 in only one or two axis of the elevator car 103 At 320, the algorithm 300 is configured to monitor one axis at a time for a significant event 305. For example, the algorithm 300 may be monitoring the Z axis for a significant event 305 along the Z axis. The significant event 305 along the Z axis may be an elevator car 103 stopping. An elevator car 103 stopping may produce a specific vibratory signature along the Z axis, and thus once that specific vibratory signature 310 is detected along the Z axis then, it may be determined that the elevator car 103 is stopping. A plurality of vibratory signatures 310 may be stored in the memory 216 of the sensing apparatus 210 and the algorithm 300 can match a detected vibratory signature 310 with a stored vibration signature to identify a significant event 305 by comparing vibration characteristics in time and vibration domain by defining the key characteristics, etc. For example, an acceleration is sensed in the upward direction with a magnitude that is greater than some predetermined value, and lasts longer than some other predetermined length of time.

Figure 4A:
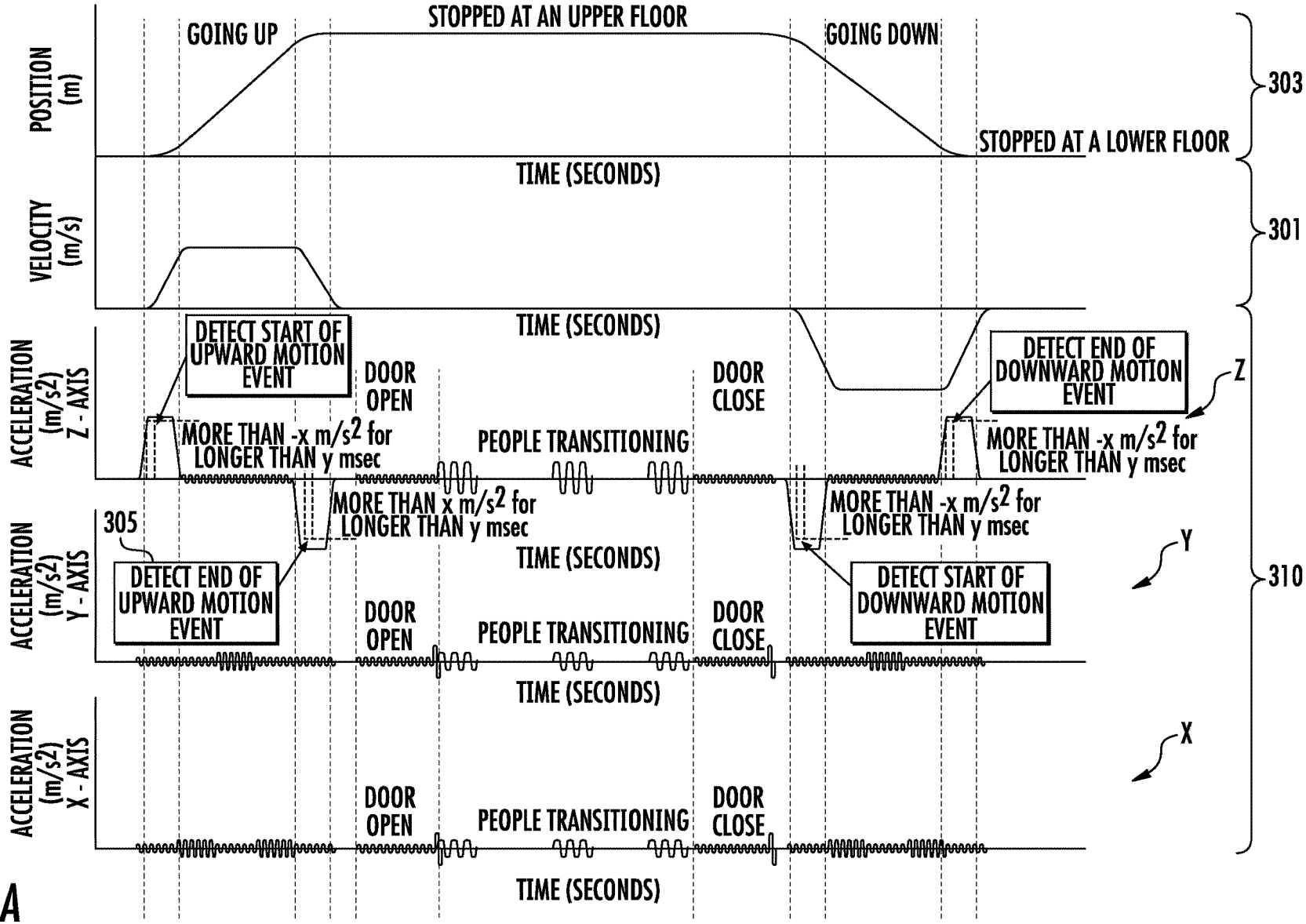
FIG. 4*a* illustrates a timeline of detections by the sensing apparatus of FIG. 4 for use in a sensing algorithm, in accordance with an embodiment of the disclosure.
Figure 4B:
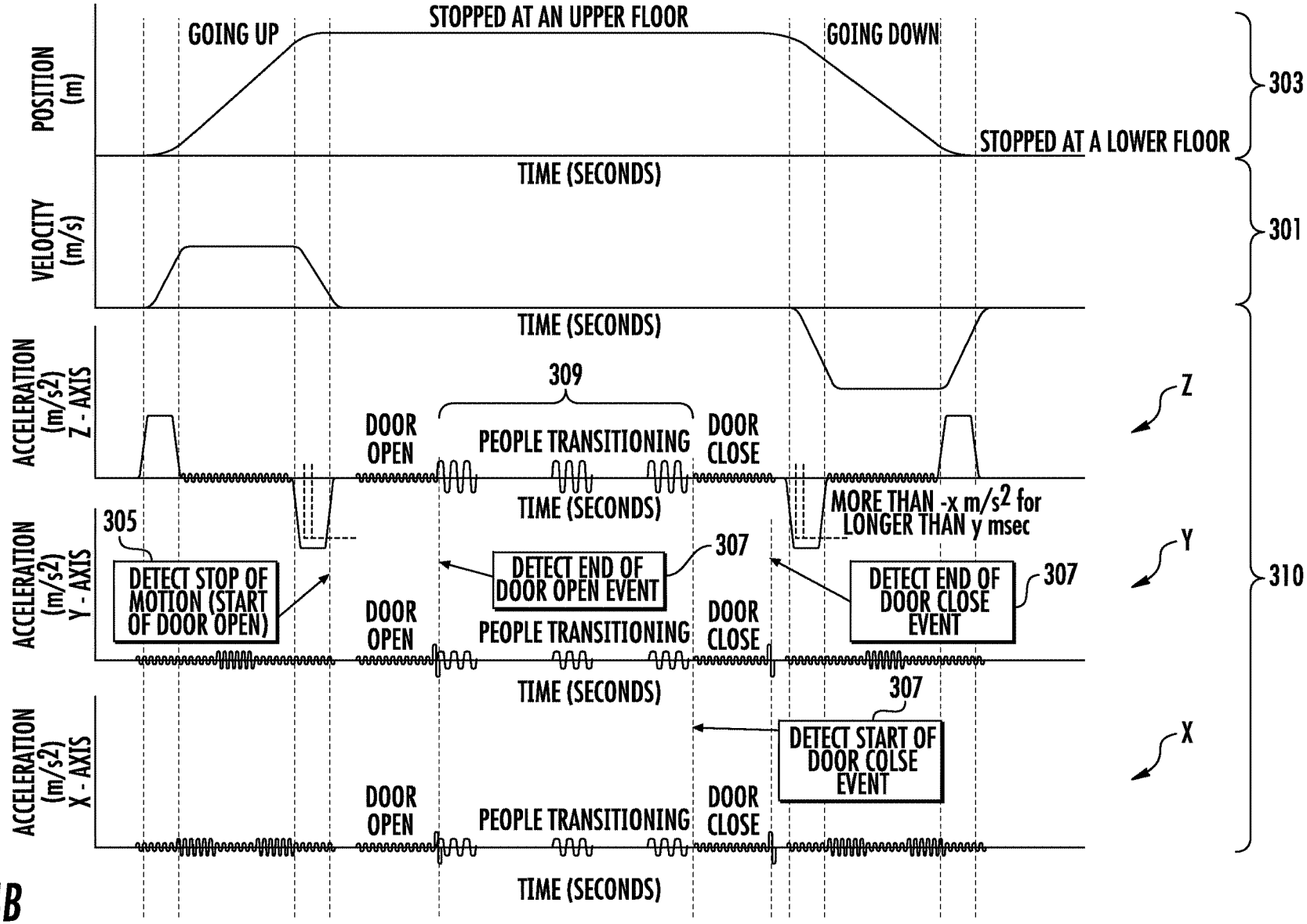
FIG. 4*b* illustrates a timeline of detections by the sensing apparatus of FIG. 4 for use in a sensing algorithm, in accordance with an embodiment of the disclosure.

A timeline of a velocity 301 of the elevator car 103 and a position 303 of the elevator car 103 along with the vibrational signatures 310 along the X-axis, the Y-axis, and the Z-axis is shown in FIGS. 4*a* and 4*b* to aid in explanation of the algorithm 300. Once the significant event 305 is identified then the algorithm 300 will analyze one or more additional axis after and/or before the significant event 305 for a select period of time T1. For example, as shown in FIG. 4*a*, if the significant event 305 of an elevator car 103 stopping is identified by monitoring the Z axis then any vibrations in the X axis, Z-axis, or the Y axis after the elevator car 103 stopped may indicate a door event 307 occurred (i.e., the doors 104 of the elevator car 103 opened or closed). A detection of a door event 307 may indicate that passengers got in or out of the elevator car during the door event 307. Further, there may be additional vibrations 309 along the Z axis or any other axis (e.g. X-axis, Y-axis) proximate the door event 307 as passengers move in and out of the elevator car 103 and shake the elevators up and down along the Z axis as the passengers walk, as shown in FIG. 4*b*. The elevator system 100 may use the detection of passengers boarding the elevator car 103 for filtering, labeling the signal/detecting presence or confirming a 'Door Fully Open' state of the elevator door 104. If there is no detection of a door event 307 after a significant event 305 then perhaps the elevator car 103 stopped in the hoistway 117 and is waiting for an elevator call to be received. Advantageously, a single sensing apparatus 210 placed on the door header 104*e* may eliminate the need for additional sensing devices on the doors 104 of the elevator car 103 and clearly detect motion of the elevator car 103 and door 104 movement. A single sensing apparatus 210 also leads to lower material costs and reduced installation time. Also advantageously, the door performance may be monitored in reference to each landing 125.

Figure 5:
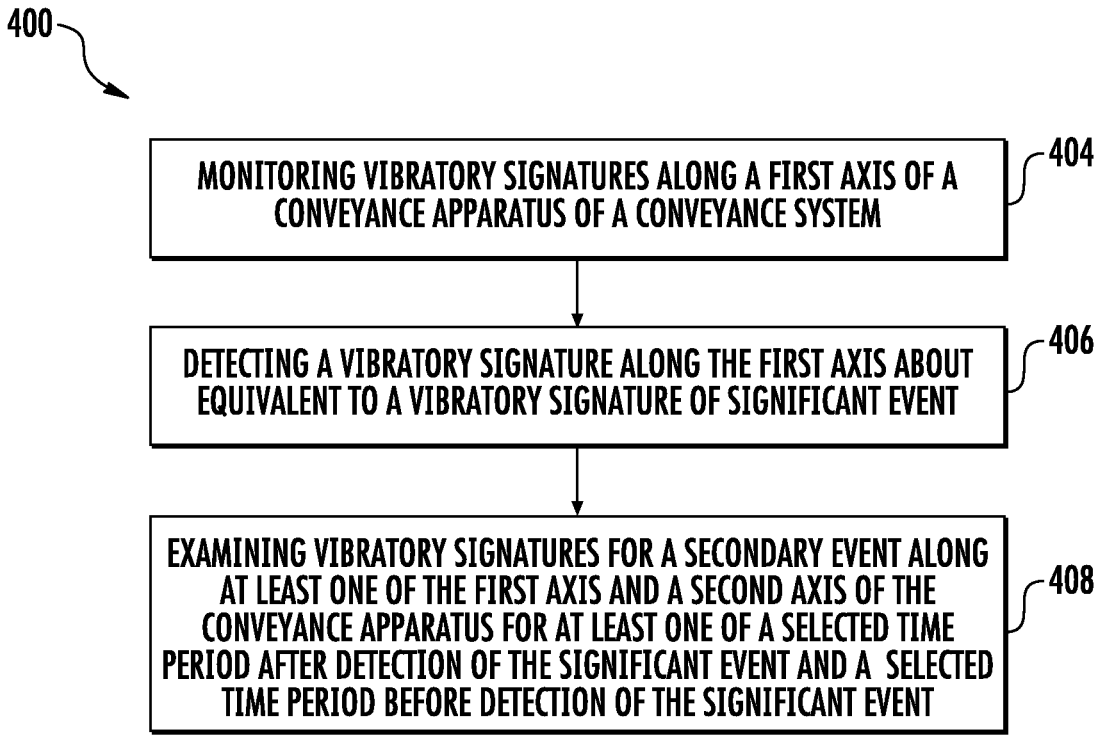
FIG. 5 is a flow chart of a method of monitoring a conveyance system, in accordance with an embodiment of the disclosure.

Referring now to FIG. 5, while referencing components of FIGS. 1-4. FIG. 5 shows a flow chart of a method 400 for monitoring a conveyance system, in accordance with an embodiment of the disclosure. At block 404, vibratory signatures 310 are monitored along a first axis of a conveyance apparatus of a conveyance system. In an embodiment, the conveyance system is an elevator system 101 and the conveyance apparatus is an elevator car 103 of the elevator system 101. In an embodiment, the first axis is the Z axis, as seen in FIG. 2, and is about parallel with the hoistway 117 in a direction of gravity. In an embodiment, the vibratory signatures 310 along the first axis are detected at a header 104*e* of the elevator car 103, when the conveyance system is an elevator system 101.

At block 406, a vibratory signature 310 along the first axis about equivalent to a vibratory signature of significant event 305 is detected. At block 408, vibratory signatures 310 are examined for a secondary event along at least one of the first axis and a second axis of the conveyance apparatus for at least one of a selected time period after detection of the significant event and a selected time period before detection of the significant event. The second axis may be either the X axis or the Y axis. The method 400 may include examining the vibratory signatures 310 along a third axis, which may be either the X axis or the Y axis depending on the second axis. In an embodiment, each of the vibratory signatures 310 are detected at a header 104*e* of the elevator car 103. In an embodiment, the first axis is oriented about parallel to a hoistway of the elevator system in a direction of gravity (e.g., Z axis). In an embodiment, the second axis is about perpendicular to the first axis (e.g., X axis or Y axis). In another embodiment, the second axis is about parallel to doors 104 of the elevator car 103 and perpendicular to the first axis (e.g., Y axis).

The method 400 may further include: detecting a vibratory signature along at least one of the first axis and the second axis about equivalent to a vibratory signature 310 of a secondary event of the conveyance apparatus; and determining that the secondary event of the conveyance apparatus has occurred in response to the vibratory signature 310. In an embodiment, the vibratory signature of the secondary event may be a combination of vibratory signatures 310 along multiple axis. Alternatively, the method may further include: detecting no vibratory signatures 310 along at least one of the first axis and the second axis about equivalent to a vibratory signature 310 of a secondary event of the conveyance apparatus; and determining that the secondary event of the conveyance apparatus has not occurred in response to the vibratory signature. In an embodiment, the significant event 305 is a motion profile change of the elevator car 130, such as, for example, an elevator car 130 stopping, an elevator car 130 starting, an elevator car 130 jerking in/out, an elevator car 130 moving with constant speed/acceleration, or an elevator car 130 having constant jerk. In an embodiment, the significant event 305 is the elevator car 103 stopping, when the conveyance system is an elevator system 101. In another embodiment, the secondary event is a door 104 of the elevator car 103 opening or closing, when the conveyance system is an elevator system 101. In the example of FIG. 4*b* above, the secondary event was the door event 307.

While the above description has described the flow process of FIG. 5 in a particular order, it should be appreciated that unless otherwise specifically required in the attached claims that the ordering of the steps may be varied.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of monitoring an elevator system, the method comprising:

storing a plurality of vibratory signatures indicative of one or more significant events associated with the elevator system within a memory of a sensing apparatus;

monitoring, with one or more sensors including at least an inertial measurement unit sensor, and recording, with the sensing apparatus, vibratory signatures along a first axis of an elevator car of the elevator system and along a second axis of the elevator car during operation of the elevator system to obtain monitored and recorded vibratory signatures;

processing and detecting, using an algorithm of the sensing apparatus, from the monitored and recorded vibratory signatures a vibratory signature along the first axis about equivalent to at least one of the vibratory signatures indicative of at least one of the one or more significant events, wherein the inertial measurement unit sensor is attached to a door header of the elevator car and the inertial measurement unit sensor is relatively isolated from vibrations of a door of the elevator car during travel of the elevator car and configured to monitor vibratory signatures of the door during open and close operations of the door; and in response to detecting the vibratory signature indicative of a significant event of the one or more significant events, examining the monitored and recorded vibratory signatures for a secondary event along at least one of the first axis and the second axis for at least one of a selected time period after detection of the vibratory signature indicative of the significant event and a selected time period before detection of the vibratory signature indicative of the significant event.

2. The method of claim 1, further comprising:

detecting a vibratory signature along at least one of the first axis and the second axis about equivalent to a vibratory signature of a secondary event of the elevator car; and determining that the secondary event of the elevator car has occurred in response to the vibratory signature.

3. The method of claim 1, further comprising:

detecting no vibratory signatures along at least one of the first axis and the second axis about equivalent to a vibratory signature of a secondary event of the elevator car; and determining that the secondary event of the elevator car has not occurred in response to the vibratory signature.

4. The method of claim 1, wherein the significant event is a motion profile change of the elevator car.

5. The method of claim 1, wherein vibratory signatures along a first axis are detected at the door header of the elevator car.

6. The method of claim 1, wherein the significant event is the elevator car stopping, and wherein the secondary event is the door of the elevator car opening or closing.

7. The method of claim 1, wherein the first axis is oriented about parallel to a hoistway of the elevator system in a direction of gravity.

8. The method of claim 7, wherein the second axis is about perpendicular to the first axis.

9. The method of claim 8, wherein the second axis is about parallel to the door of the elevator car.

10. A sensing apparatus for monitoring an elevator system, the sensing apparatus comprising:

one or more sensors comprising at least an inertial measurement unit configured to monitor vibratory signatures of an elevator car of the elevator system, wherein the inertial measurement unit is attached to a door header of the elevator car and the inertial measurement unit is relatively isolated from vibrations of a door of the elevator car during travel of the elevator car and wherein the inertial measurement unit is configured to monitor vibratory signatures of the door during open and close operations of the door;

a controller configured to analyze the vibratory signatures monitored by the inertial measurement unit, the controller comprising:

a processor; and a memory comprising computer-executable instructions that, when executed by the processor, cause the processor to perform operations, the operations comprising:

storing, in the memory, a plurality of vibratory signatures indicative of one or more significant events associated with the elevator system;

recording in the memory vibratory signatures monitored by the inertial measurement unit along a first axis of the elevator car of the elevator system and along a second axis of the elevator car during operation of the elevator system to obtain monitored and recorded vibratory signatures;

detecting, using an algorithm that is part of the computer-executable instructions, from the monitored and recorded vibratory signatures a vibratory signature along the first axis about equivalent to at least one of the vibratory signatures indicative of at least one of the one or more significant events; and in response to detecting the vibratory signature indicative of a significant event of the one or more significant events, examining the monitored and recorded vibratory signatures for a secondary event along at least one of the first axis and the second axis of the elevator car for at least one of a selected time period after detection of the vibratory signature indicative of the significant event and a selected time period before detection of the vibratory signature indicative of the significant event.

11. The sensing apparatus of claim 10, wherein the operations further comprise:

detecting a vibratory signature along at least one of the first axis and the second axis about equivalent to a vibratory signature of a secondary event of the elevator car; and determining that the secondary event of the elevator car has occurred in response to the vibratory signature.

12. The sensing apparatus of claim 10, wherein the operations further comprise:

detecting no vibratory signatures along at least one of the first axis and the second axis about equivalent to a vibratory signature of a secondary event of the elevator car; and determining that the secondary event of the elevator car has not occurred in response to the vibratory signature.

13. The sensing apparatus of claim 10, wherein the significant event is a motion profile change of the elevator car.

14. The sensing apparatus of claim 10, wherein vibratory signatures along a first axis are detected at the door header of the elevator car.

15. The sensing apparatus of claim 10, wherein the significant event is the elevator car stopping, and wherein the secondary event is the door of the elevator car opening or closing.

16. The sensing apparatus of claim 10, wherein the first axis is oriented about parallel to a hoistway of the elevator system in a direction of gravity.

17. The sensing apparatus of claim 16, wherein the second axis is about perpendicular to the first axis.

18. The sensing apparatus of claim 17, wherein the second axis is about parallel to the door of the elevator car.

* * * * *